US008657513B2

(12) United States Patent
Bennett

(10) Patent No.: US 8,657,513 B2
(45) Date of Patent: Feb. 25, 2014

(54) SYSTEM FOR REDUCING RESIDUAL MATERIAL RETAINED IN A DISPENSER

(76) Inventor: Sally J. Bennett, San Francisco, CA (US)

( * ) Notice: Subject to any disclaimer, the term of this patent is extended or adjusted under 35 U.S.C. 154(b) by 341 days.

(21) Appl. No.: 13/050,678

(22) Filed: Mar. 17, 2011

(65) Prior Publication Data

US 2011/0229244 A1 Sep. 22, 2011

Related U.S. Application Data

(60) Provisional application No. 61/340,401, filed on Mar. 17, 2010.

(51) Int. Cl.
*A45D 40/20* (2006.01)

(52) U.S. Cl.
USPC ..... 401/88; 401/87

(58) Field of Classification Search
USPC ..... 401/87, 88, 75–78; 222/386, 390
See application file for complete search history.

(56) References Cited

U.S. PATENT DOCUMENTS 1,527,851 A * 2/1925 Estes ..... 401/88
5,954,441 A * 9/1999 Welschoff ..... 401/75

* cited by examiner

*Primary Examiner* — David Walczak
(74) *Attorney, Agent, or Firm* — William C. Milks, III

(57) ABSTRACT

A system to dispense consumable material includes an inner tube having a cone-shaped reservoir such that only a relatively small amount of residual material is retained.

14 Claims, 7 Drawing Sheets

SYSTEM FOR REDUCING RESIDUAL MATERIAL RETAINED IN A DISPENSER

CROSS-REFERENCE TO RELATED PATENT APPLICATION

This application relates to U.S. Provisional Patent Application No. 61/340,401 filed on Mar. 17, 2010, entitled SYSTEM FOR REDUCING RESIDUAL MATERIAL RETAINED IN A DISPENSER, which is hereby incorporated herein in its entirety by this reference.

BACKGROUND OF THE INVENTION

1. Field of the Invention

The present invention relates generally to dispensing consumable material and, more particularly, to dispensing consumable material such as cosmetics (for example, lipstick), medicinal products, health and beauty products, personal hygiene products, or other consumable substances. More particularly, various examples of the present invention provide a system for reducing the amount of unused residual material retained in a dispensing device wherein the consumable material is extended from a housing of the dispensing device during use and retractable back within the housing between uses. In one example, a telescoping twist-type tube dispenser for dispensing lipstick is provided wherein the residual amount of lipstick retained is decreased, thereby reducing waste.

2. Description of the Prior Art

Various types of dispensing devices for consumable material such as cosmetics, medicinal products, or other consumable substances are known. By way of example, Kendall, U.S. Pat. No. 2,263,632 discloses a lipstick holder comprising a telescopically constructed casing to enclose the lipstick material, whereby as the lipstick material is worn away in use the sections of the casing collapse one within the other to expose the tip of the lipstick. Considered in more detail, as the lipstick material is consumed, the pressure of a flange against the lips of a user causes an outer section to push into a mid-section and further expose the tip of the lipstick as the lipstick is worn away. The sections continue to collapse one into the next until the amount of lipstick material that is accessible has been used. Nevertheless, as shown in FIG. 3 of the Kendall patent, an amount of residual lipstick material is retained in a cylindrical section 13 when the sections 14 and 15 are fully collapsed. On the other hand, advantageously, a new lipstick may be substituted for the used one by simply removing a holder 25 shown in FIG. 3 of the Kendall patent and replacing it with a new stick of lipstick material at the same time re-extending the sections 14 and 15 to contain the new stick.

Furthermore, an example of a twist-type tube dispenser for lipstick is shown in Anderson, U.S. Pat. No. 2,395,710 which discloses a dispensing container of the applicatory type adapted to serve as a hollow handle for holding, projecting, and retracting a contained body of dispensable substance, such as a stick-like body of cosmetic, medicinal, hygienic, or marking material, for example, lipstick. The Anderson patent places in screw-threaded operative relationship certain telescoping parts that comprise a core internal and exclusive of an outer casing, and which are located between the bottom end of the outer casing and the nearest, or bottom, end of the carrier for the lipstick when the lipstick is in a projected position ready for use. This makes it unnecessary to provide the outer casing with any screw thread or groove whatever, if preferred, so that the wall of the casing shell may be made even thinner than before and the lipstick carrier need not rotate with respect to the casing shell in order to be projected and retracted. In one embodiment, the mechanical actuating parts comprise a working mechanism composed of overlapped sleeve-like telescoping members which have screw camming engagement with each other, for example, in the form of a helical guideway and follower lug. The assembly comprises telescoping members in which the extent of axial separation of the members is limited by one or more blind-ended grooves slidably engaged by some form of follower projection, or lug, carried, on an associated telescopic part so that sliding of the lug along the groove causes screw-like relative movement between the telescoping members. As shown in FIG. 1 of the Anderson patent, the bottom of lipstick 30 is seated on an annular shoulder 31 and fits within and is steadied by a surrounding rim 29 of a carrier plunger 25. Conventionally, as much as approximately one-third of the consumable material such as lipstick is retained in the structure in which the lipstick is mounted and is therefore wasted.

There are thus shortcomings to the above and other known dispensing devices for lipstick and similar consumable materials due to the residual material that is wasted. There have been attempts to reduce the amount of residue, but the structures of the resulting dispensing devices have been structurally complicated and thus costly to manufacture. For example, the dispensing device disclosed in Olson, U.S. Pat. No. 3,338,474 provides a collapsible container constructed for dispensing substantially all of the material contained therein. As shown in FIG. 6 of the Olson patent, within a dispensing container 52, and at the dispensing end 54, there is located a solid material such as lipstick which is to be dispensed. A sealing and supporting member 56 is attached by means of a number of prongs 57 to the solid material 55. A corrugated sleeve 67 is cemented or otherwise fastened to one end of the member 56 to provide a positive grip, in moving the sealing member 56 toward the dispensing end 54 or in moving the end piece 59 towards the sleeve 67. The collapsing wall 53 is constructed of resilient material such as spring steel to provide a resilient and yet firm collapsing wall for the dispensing container 52. Another structure intended to dispense substantially all of a consumable material such as lipstick is disclosed in Japanese Published Patent Application No. JP 08196343 A in which a cylindrical container for make-up such as lipstick has a pushing rod 27 of a pushing part 25 below a support board 26 for the lipstick. When the pushing rod 27 is operated, the lipstick is further extended from the cylindrical container.

In view of the shortcomings of known dispensing devices, one preferred example in accordance with the present invention provides a system for reducing the amount of unused residual material retained in a dispensing device wherein the consumable material is extended from a housing of the dispensing device during use and retractable back within the housing between uses, which has an uncomplicated construction. The invention thus solves the long-extant problem of delivering a consumable product in a dispensing device such as a telescoping twist-type tube dispenser, for example, a lipstick container, so that substantially all of the product is consumed. Furthermore, various examples of the present invention provide an improved device of the character described that presents a pleasing appearance and which may be manufactured at low cost.

SUMMARY OF THE INVENTION

It is a general object of the present invention to provide an apparatus to efficiently dispense consumable material such that only a relatively small amount of residual material is retained, thus reducing waste. Generally, the examples in accordance with the present invention are structured to reduce the amount of residual material such as lipstick in a twist-type tube telescoping dispensing device by providing a cone-shaped interior reservoir for the material.

Various examples are provided in accordance with the present invention. In accordance with a first example, a cylindrical inner tube comprising the dispensing device is configured with a cone-shaped interior reservoir for the consumable material, which differs from a conventional device by having a cone-shaped reservoir for the material instead of the conventional cylindrical reservoir. In accordance with a second example, a cone-shaped inner tube is provided having a cone-shaped reservoir for the consumable material, which telescopes within a cylindrical outer tube. In accordance with a third example, a cone-shaped inner tube is provided having a cone-shaped reservoir that telescopes within a cone-shaped outer tube. In accordance with the various examples, the cone tapers off gradually until there is almost no consumable material remaining, resulting in substantially no waste.

Accordingly, the apparatus in accordance with the various examples of the present invention take a different approach from known twist-type lube dispensers for consumable material. This transforms the dispensing device into a less wasteful and more cost effective structure for consumable material such as lipstick.

The foregoing and other objects, features, and advantages of the present invention will become more readily apparent from the following detailed description of various examples, which proceeds with reference to the accompanying drawing.

BRIEF DESCRIPTION OF THE DRAWING

The various examples of the present invention will be described in conjunction with the accompanying figures of the drawing to facilitate an understanding of the present invention. In the figures, like reference numerals refer to like elements. In the drawing.

DETAILED DESCRIPTION OF THE EXAMPLES OF THE INVENTION

The dispensing device in accordance with various examples of the present invention comprises a cone-shaped reservoir for consumable material, for example, lipstick, in which the cone tapers off gradually until there is almost no material remaining. This, results in substantially no waste.

Figure 1:
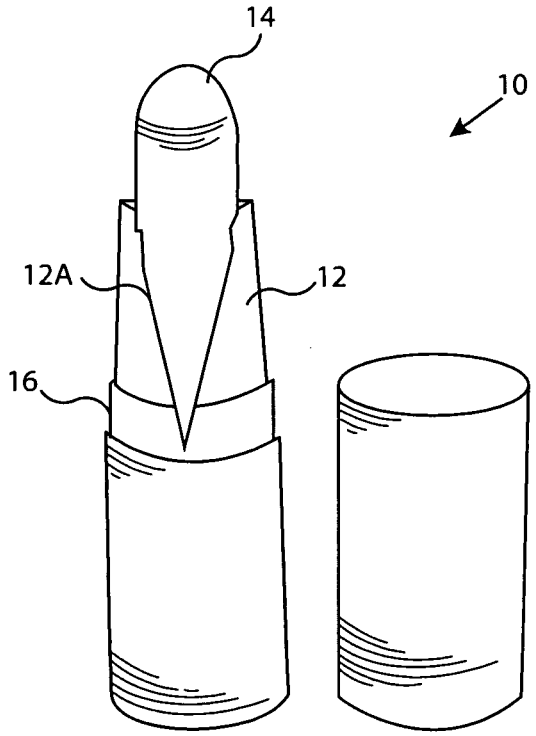
FIG. 1 is an isometric view illustrating an example of the dispensing device in accordance, with the present invention, in which a cylindrical inner tube is configured with a cone-shaped interior reservoir for consumable material, which differs from a conventional device by having a cone-shaped reservoir for the material.

Various examples are provided in accordance with the present invention. For example, as shown in FIG. 1, a dispensing device 10 comprises a cylindrical inner tube 12 having a cone-shaped reservoir 12A for consumable material 14, for example, lipstick, which differs from a conventional twist-type tube dispensing device such as disclosed in aforementioned Anderson, U.S. Pat. No. 2,395,710 by having the cone-shaped reservoir for the material. The disclosure in the Anderson patent is hereby incorporated in its entirety by this reference and discloses an example of structure that may be incorporated to extend and retract the cylindrical inner tube 12 shown in FIG. 1 having the cone-shaped reservoir 12A for consumable material 14. As shown in FIG. 1, the cylindrical inner tube 12 telescopes within a cylindrical outer tube 16 as is well-known to persons skilled in the art. Other structures known to those persons skilled in the art may alternatively be employed for extending and retracting a cylindrical inner tube such as the cylindrical inner tube 12 shown in FIG. 1. In accordance with one contemplated modification, the first example could be constructed by inserting a stick of consumable material such as lipstick having a conical base into a cone-shaped holder and press-fitting the holder into the cylindrical inner tube 12.

Figure 2:
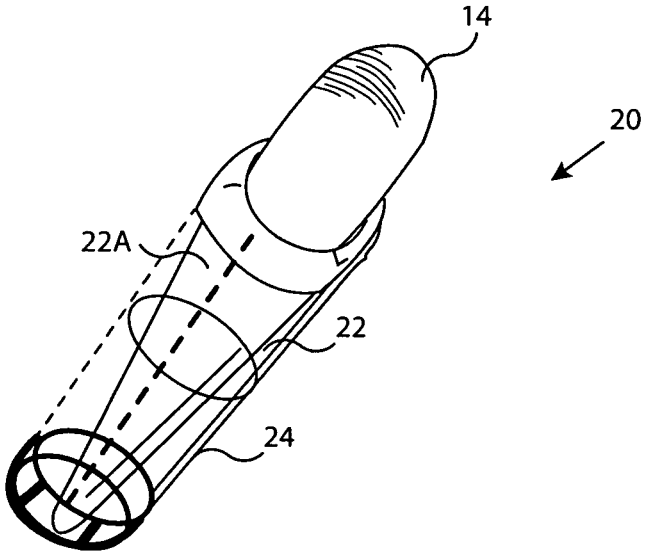
FIG. 2 is a partial cutaway view illustrating an alternative example of the dispensing device in accordance with the present invention, in which a cone-shaped inner tube having a cone-shaped reservoir is provided, which telescopes within a cylindrical outer tube.

In accordance with an alternative example, as shown in FIG. 2, a dispensing device 20 comprises a cone-shaped inner tube 22 having a cone-shaped reservoir 22A for consumable material 14, for example, lipstick. The cone-shaped inner tube 22 telescopes within a cylindrical outer tube 24.

Figure 3:
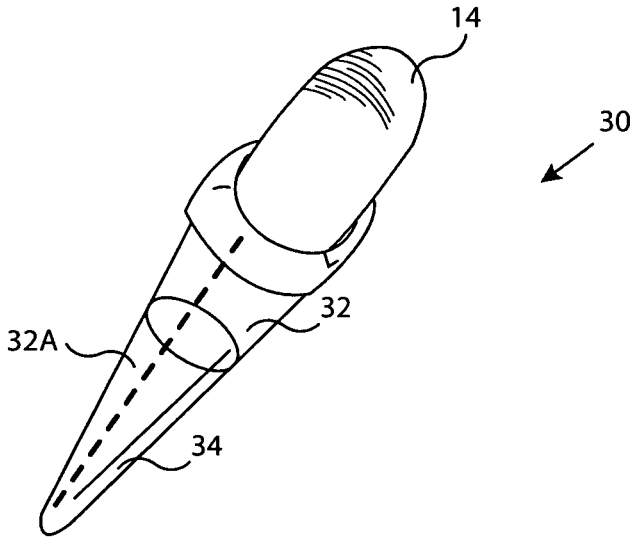
FIG. 3 is isometric view illustrating another alternative example of the dispensing device in accordance with the present invention, in which a cone-shaped inner tube, having a cone-shaped reservoir is provided, which telescopes within a cone-shaped outer tube.

In accordance with another alternative example, as shown in FIG. 3, a dispensing device 30 comprises a cone-shaped inner tube 32 having a cone-shaped reservoir 32A for consumable material 14, for example, lipstick. The cone-shaped inner tube 32 telescopes within a cone-shaped outer tube 34.

Figure 4:
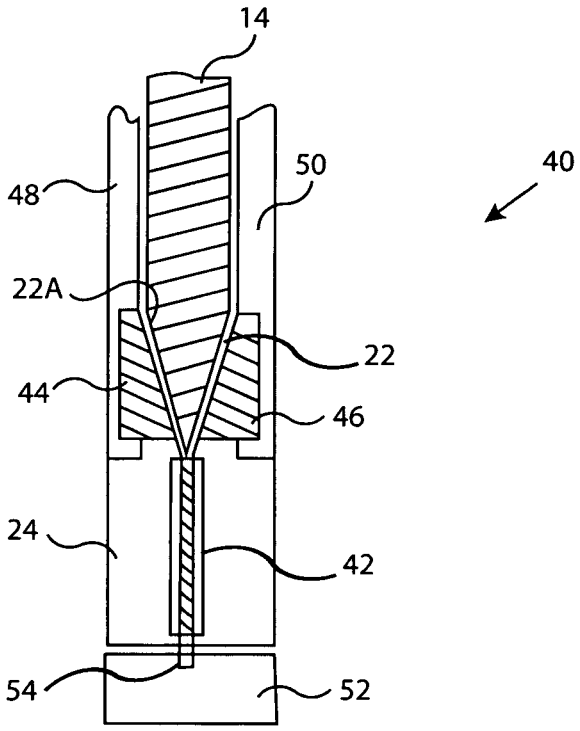
FIG. 4 illustrates a partial cutaway view of an example of a mechanism for extending and retracting an inner tube having a cone-shaped reservoir of consumable material comprising the example shown in FIG. 2.

FIG. 4 shows a structure 40 for incorporation into the dispensing device 20 (FIG. 2) for selectively extending and retracting the consumable material 14. Considered in more detail, the structure 40 comprises the cone-shaped inner tube 22 having the cone-shaped reservoir 22A. The cone-shaped inner tube 22 is coupled to an internally threaded sleeve 42. A least one flange 44 is provided, and, preferably, as shown in FIG. 4 a second flange 46 is provided, on the exterior of the cone-shaped inner lube 22. Additionally, at least one guideway 48 is provided, and, preferably, as indicated in FIG. 4 a second guideway 50 is provided, on the interior of the cylindrical outer tube 24, such that the flange 44 is slidable in the guideway 48, and, preferably, the flange 46 is slidable in the guideway 50. Additionally, as shown in FIG. 4, a rotatable element 52 is provided having an externally threaded shaft 54 mounted to the rotatable element. The shaft 54 threads into the sleeve 42. Rotation of the rotatable element 52 imparts linear motion to the cone-shaped inner lube 22 as the flanges 44, 46 slide in the guideways 48, 50 for selectively extending and retracting the consumable material 14 with respect to the cylindrical outer tube 24.

Figure 5:
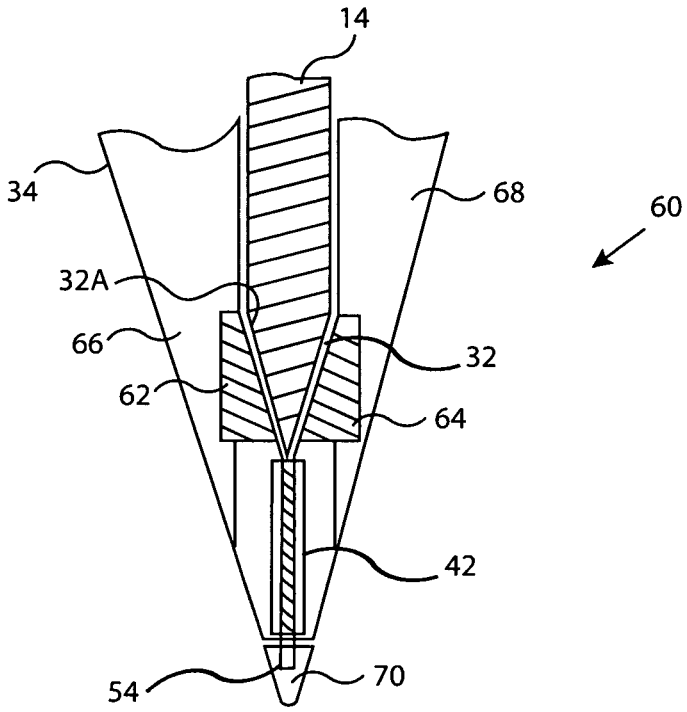
FIG. 5 illustrates a partial cutaway view of an alternative example of a mechanism for extending and retracting an inner tube having a cone-shaped reservoir of consumable material comprising the example shown in FIG. 3.

FIG. 5 shows a structure 60 for incorporation into the dispensing device 30 (FIG. 3) for selectively extending and retracting the consumable material 14. Considered in more detail, the structure 60 comprises the cone-shaped inner tube 32 having the cone-shaped reservoir 32A. The cone-shaped inner tube 32 is coupled to an internally threaded sleeve 42. A least one flange 62 is provided, and, preferably, as shown in FIG. 5 a second flange 64 is provided, on the exterior of the cone-shaped inner tube 32. Additionally, at least one guideway 66 is provided, and, preferably, as indicated in FIG. 5 a second guideway 68 is provided, on the interior of the cone-shaped outer tube 34, such that the flange 62 is slidable in the guideway 66, and, preferably, the flange 64 is slidable in the guideway 68. Additionally, as shown in FIG. 5, a rotatable element 70 is provided having an externally threaded shaft 54 mounted to the rotatable element. The shaft 54 threads into the sleeve 42. Rotation of the rotatable element 70 imparts linear motion to the cone-shaped inner tube 32 as the flanges 62, 64 slide in die guideways 66, 68 for selectively extending and retracting the consumable material 14 with respect to the cone-shaped outer tube 34.

As shown in FIGS. 4 and 5, the cone-shaped inner tube 22 or 32 is retained in the respective outer tube 24 or 34 by threaded interconnection of the threaded shall 54 with the sleeve 42. Advantageously, a new stick of consumable material such as lipstick may be substituted for a used one by simply rotating the rotatable element 52 or 70 until the sleeve 42 releases from the threaded shaft 54, removing the cone-shaped inner tube 22 or 32 and replacing it with a new cone-shaped inner tube having a new stick of material, and rotating the rotatable element 52 or 70, respectively, until the new cone-shaped inner rube having the new slick of material is retracted into the respective outer tube 24 or 34 to contain the new stick.

Figure 6:
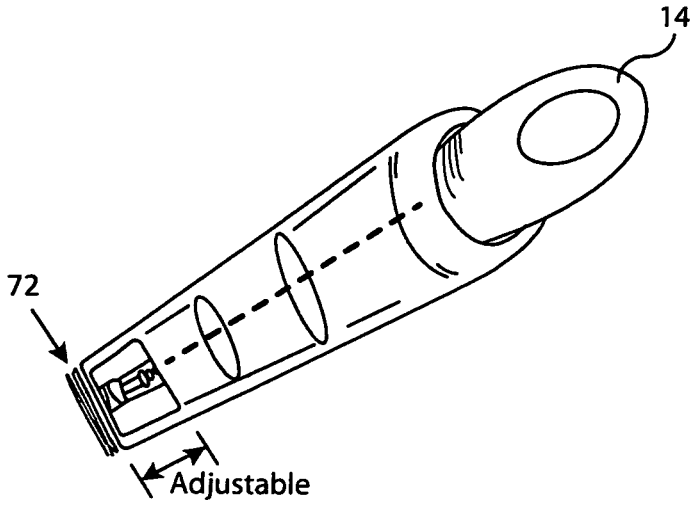
FIG. 6 illustrates a partial cutaway view of a contemplated modification that involves releasing remaining consumable material comprising a plunger at the bottom of a truncated cone-shaped reservoir containing the material.

Another contemplated modification is illustrated in FIG. 6 and involves releasing the remaining consumable material 14, for example, lipstick, by pushing on a plunger 72 at the bottom of the cone-shaped reservoir 22A or 32A containing the material. For example, the plunger mechanism disclosed in Japanese Published Patent Application No. JP 08196343 A may be adapted and incorporated. When the consumable material 14 is apparently used up and the surface of the material is flat, one can fully retract the material as far as possible, and the plunger 72 releases what remains by pushing on the material at the bottom of the cone-shaped reservoir 22A or 32A containing the material. The plunger 72 only releases when the consumable material reaches the point of what is currently the stage when the dispensing device 20, 30 is discarded. Preferably, the motion can be reversed so that the plunger 72 can be reset.

Figure 7:
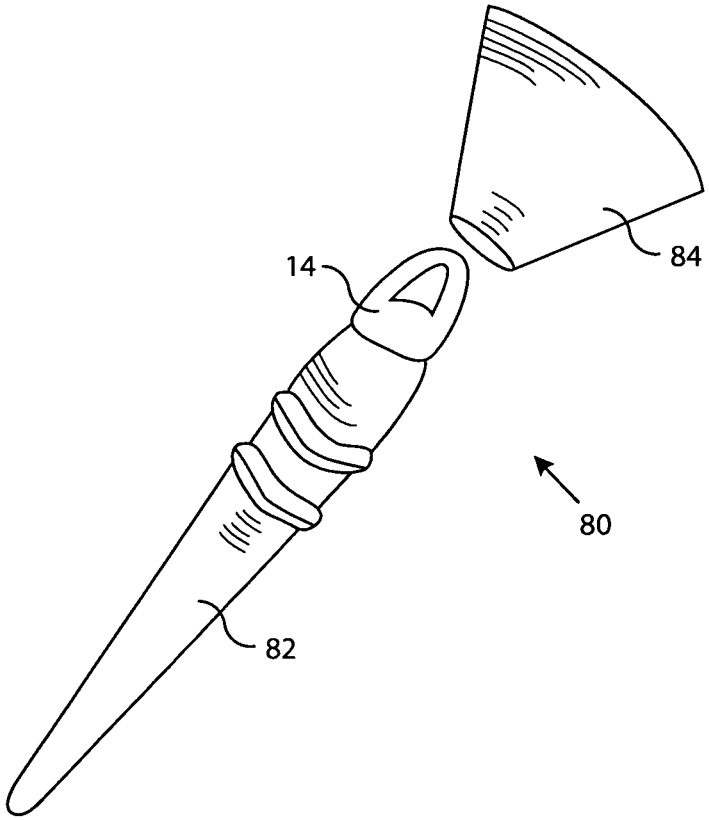
FIG. 7 is an isometric view of an alternative example of the dispensing device in accordance: with the present invention similar to the dispensing device shown in FIG. 3 in which a cone-shaped inner tube having a cone-shaped reservoir telescopes within a cone-shaped outer tube, and further showing a cap that additionally functions as a base for the dispensing device.

FIG. 7 is an isometric view of an alternative example of a dispensing device 80 in accordance with the present invention similar to the dispensing device shown in FIG. 3 in which a cone-shaped inner tube is provided having a cone-shaped reservoir which telescopes within a cone-shaped outer tube 82, and further showing a cap 84. The cap 84 preferably also functions as a base for the dispensing device 80 when the cap is attached so that the dispensing device can be stably sat on a surface.

The dispensing device in accordance with the examples shown in FIGS. 1-5 and 7 and described above comprises a cone-shaped inner tube having a cone-shaped reservoir for consumable material, for example, lipstick, such that there is a reduced amount of unusable residual material that remains in the dispensing device. Considered in more detail, the volume of a cylindrical reservoir for consumable material in a conventional twist-type tube dispensing device is $\pi r^2 h$. where r is the radius of the consumable material and h is the height of the cylindrical element that forms the reservoir of residual material. In comparison, the volume of the cone-shaped reservoir incorporated in the various examples of the present invention is $\frac{1}{3}\pi r^2 h$, which means that there is only ⅓ as much residual material, thereby reducing waste.

The materials of construction of the dispensing device may be varied to suit the requirements of any specific product. The parts shown in the drawing figures may be constructed of any available plastic substances in molded or extruded form, or of different materials such as metal formed by drawing, stamping, bending, or rolling sheets thereof, or by casting or molding the material that comprises the parts. Also, as shown in FIG. 7, the design may be made to afford distinctiveness to the original product and to serve for ornamental purposes.

While the foregoing description has been with reference to particular examples of the present invention, it will be appreciated by those skilled in the art that changes in these examples may be made without departing from the principles and spirit of the invention. Accordingly, the scope of the present invention can only be ascertained with reference to the appended claims.

What is claimed is:

1. Apparatus to dispense consumable material, the apparatus comprising:
   - a consumable material;
   - an inner tube having a cone-shaped reservoir for the consumable material such that the consumable material extends beyond the cone-shaped reservoir for consumption and only a relatively small amount of unused residual material is retained within the cone-shaped reservoir;
   - an outer tube within which the inner tube telescopes for selectively extending and retracting the consumable material; and
   - a structure to selectively extend and retract the inner tube within the outer tube.

2. Apparatus according to claim 1 wherein the inner tube is cylindrical.

3. Apparatus according to claim 2 wherein the outer tube is cylindrical and the structure to selectively extend and retract the cylindrical inner tube within the cylindrical outer tube comprises an internally threaded sleeve coupled to the cylindrical inner tube, at least one flange on the exterior of the cylindrical inner tube, at least one guideway on the interior of the cylindrical outer tube, such that the at least one flange is slidable in the at least one guideway, a rotatable element having an externally threaded shaft mounted to the rotatable element and threaded into the sleeve, wherein rotation of the rotatable element imparts linear motion to the cylindrical inner tube as the at least one flange slides in the at least one guideway for selectively extending and retracting the consumable material with respect to the cylindrical outer tube.

4. Apparatus according to claim 1 wherein the inner tube is cone-shaped.

5. Apparatus according to claim 4 wherein the outer tube is cone-shaped and the structure to selectively extend and retract the cone-shaped inner tube within the cone-shaped outer tube comprises an internally threaded sleeve coupled to the cone-shaped inner tube, at least one flange on the exterior of the cone-shaped inner tube, at least one guideway on the interior of the cone-shaped outer tube, such that the at least one flange is slidable in the at least one guideway, a rotatable element having an externally threaded shaft mounted to the rotatable element and threaded into the sleeve, wherein rotation of the rotatable element imparts linear motion to the cone-shaped inner tube as the at least one flange slides in the at least one guideway for selectively extending and retracting the consumable material with respect to the cone-shaped outer tube.

6. Apparatus according to claim 1 wherein the consumable material is a material selected from among the group of consumable products consisting of cosmetic products, medicinal products, health and beauty products, and personal hygiene products.

7. Apparatus according to claim 1 wherein the consumable material is lipstick.

8. Apparatus according to claim 1 wherein the structure to selectively extend and retract the inner tube within the outer tube is a twist-type tube structure comprising overlapped sleeve-like telescoping members which have screw-camming engagement with each other.

9. Apparatus according to claim 8 wherein the screw-camming engagement comprises a helical guideway and follower lug.

10. Apparatus according to claim 1, further comprising a plunger to release the unused consumable material from the cone-shaped reservoir.

11. Apparatus according to claim 1, further comprising a cap.

12. Apparatus according to claim 11 wherein the cap comprises a base to stably support the apparatus on a surface.

13. Apparatus according to claim 1 wherein the cone-shaped reservoir has a radius r and a height h and the unused residual consumable material has a volume $\frac{1}{3}\pi r^2 h$.

14. Apparatus according to claim 1 wherein the inner tube, outer tube, and structure to selectively extend and retract the inner tube within the outer tube are constructed of plastic substances in molded or extruded form, or metal formed by drawing, stamping, bending, or rolling sheets thereof, or by casting, or combinations thereof.

* * * * *